US007683224B2

(12) United States Patent
Connor

(10) Patent No.: US 7,683,224 B2
(45) Date of Patent: Mar. 23, 2010

(54) FUEL FOR JET, GAS TURBINE, ROCKET AND DIESEL ENGINES

(75) Inventor: Daniel Stedman Connor, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 845 days.

(21) Appl. No.: 10/902,729

(22) Filed: Jul. 29, 2004

(65) Prior Publication Data

US 2005/0027148 A1 Feb. 3, 2005

Related U.S. Application Data

(60) Provisional application No. 60/491,721, filed on Aug. 1, 2003.

(51) Int. Cl.
*C10L 1/16* (2006.01)
*C07C 9/00* (2006.01)

(52) U.S. Cl. ..... 585/14; 208/15

(58) Field of Classification Search ..... 585/15, 585/14; 208/15

See application file for complete search history.

(56) References Cited

U.S. PATENT DOCUMENTS

| | | | | | |
|---|---|---|---|---|---|
| 3,773,652 | A | * | 11/1973 | Dille et al. | 585/265 |
| 3,914,934 | A | * | 10/1975 | Nestor | 60/208 |
| 4,251,346 | A | | 2/1981 | Dry et al. | |
| 4,318,797 | A | | 3/1982 | Jager et al. | |
| 4,330,302 | A | * | 5/1982 | Taylor | 44/322 |
| 4,871,444 | A | | 10/1989 | Chen et al. | |
| 5,171,916 | A | | 12/1992 | Le et al. | |
| 6,274,029 | B1 | | 8/2001 | Wittenbrink et al. | |
| 6,296,757 | B1 | | 10/2001 | Wittenbrink et al. | |
| 6,309,432 | B1 | | 10/2001 | Wittenbrink et al. | |
| 6,392,109 | B1 | | 5/2002 | O'Rear et al. | |
| 2003/0085153 | A1 | * | 5/2003 | O'Rear | 208/63 |

FOREIGN PATENT DOCUMENTS

| | | | |
|---|---|---|---|
| WO | WO 00/23549 | * | 4/2000 |
| WO | WO 02/22766 A | | 3/2002 |

OTHER PUBLICATIONS

G.C. Feighner, The Manufacture of Detergent Alkylate, Journal American Oil Chemists Society, 1958, pp. 520-524, 35.

Kirk-Othmer, Encyclopedia of Chemical Technology, 3rd Edition, vol. 2, 1978, pp. 59-61.

Kirk-Othmer, Encyclopedia of Chemical Technology, 2nd completely revised edition, vol. 16, 1968, pp. 581-582.

J. Cummins, M. Yoneyama, Nonene (Propylene Trimer) and Tetramer, SRI International, Chemical Economics Handbook, Aug. 2001 pp. 678.5000A-P.

New solid-bed alkylation technology for LAB, World Surfactants Congress, 4th, Barcelona, Jun. 3-7, 1996, pp. 177-189.

Ullmann's Encyclopedia of Industrial Chemistry, 6th Completely Revised Edition, 2003, vol. 35, pp. 293-368.

Kirk-Othmer, Encyclopedia of Chemical Technology, 4th Edition, 1992, vol. 3, pp. 788-812.

Kirk-Othmer, Encyclopedia of Chemical Technology, 4th Edition, 1994, vol. 12, pp. 341-342; 373-388.

Gerhartz, W.; Yamamoto, Y.S., Ullmann's Encyclopedia of Industrial Chemistry, vol. A1, 1985, Weinheim, VCH Verlag., DE, XP002331665, p. 190, col. 1, paragraph 2.1.

Kirk-Othmer, Petroleum Composition, Encyclopedia of Chemical Technology, p. 845 and p. 853, vol. 14, Second Edition, Copyright © 1967 by John Wiley & Sons, Inc.

Kirk-Othmer, Petroleum, Encyclopedia of Chemical Technology, p. 570 and pp. 575-594, vol. 18, Fifth Edition, Copyright © 2006 by John Wiley & Sons, Inc.

Robert A. Meyers, Handbook of Petroleum Refining Processes, pp. 7.21 through 7.32, p. 7.38 and p. 7.40, Second Edition, Copyright © 1967 by The McGraw-Hill Companies, Inc.

* cited by examiner

*Primary Examiner*—Walter D Griffin
*Assistant Examiner*—Lessanework Seifu
(74) *Attorney, Agent, or Firm*—Laura R. Grunzinger

(57) ABSTRACT

A fuel or fuel blendstock for jet, gas turbine, rocket, and diesel engines, particularly jet, rocket, and diesel engines that utilizes components of conventional petroleum not currently utilized for jet, gas turbine, rocket, and diesel fuels, such as benzene, linear, and lightly branched alkanes, that may be alkylated with aromatic moieties to make monoaromatics for use in jet and diesel fuels. Additionally, a fuel having such monoaromatics having multiple desired properties such as higher flash point, low pour point, increased density, better lubricity, aerobic degradability, reduction in toxicity, and additionally can deliver benefits in blendstocks.

12 Claims, No Drawings

FUEL FOR JET, GAS TURBINE, ROCKET AND DIESEL ENGINES

FIELD OF THE INVENTION

The present invention relates to a fuel or fuel blendstock for jet, gas turbine, rocket, and diesel engines, particularly jet, rocket, and diesel engines.

BACKGROUND OF THE INVENTION

The availability and quality of natural resources for jet, gas turbine, rocket, and diesel fuels presents unique and difficult technical challenges. An identified problem is the increasing demand for jet and diesel fuels for aircraft and for motor vehicles. As quality requirements for fuels are increasing, the ability to produce acceptable fuels from a conventional petroleum barrel of crude is decreasing. Due to the fact that conventional barrels of crude are becoming, on the average, heavier (e.g., more polycyclic) and containing more sulfur, the need for acceptable fuels is an unmet need. At the same time, the drive for cleaner fuels results in highly hydrogenated, less dense fuels that result from processing to remove sulfur and polycyclics such as naphthalenes. It is believed that highly purified conventional fuels and highly paraffinic Fischer-Tropsch fuels are of lower densities, lack seal swelling abilities, and lubricity. Restrictions on gasoline content make available carbon containing components not having any immediate uses, such as benzene and shorter chain hydrocarbons having from five to nine carbon atoms.

Circulating fuel in and around an aircraft commonly provides the sole means of cooling engines, lubes, electronics, wings, etc. of an aircraft. Significantly increased heat loads are an identified problem as fuel economy and performance considerations raise engine temperatures. More flights are using polar routes and therefore fuels must not withstand broader temperature ranges when used. The ability to raise fuel flash point to 60° C. or more while maintaining pour points below −60° C. remains an unmet need. Another desired result of raising flash points above present specifications is desirable to increase chances of surviving crashes or fires when fueling and flying aircraft.

It is also desired to have a flexible and diversified fuel source so that not only are materials for fuels derived from petroleum based components, but may be derived from natural gas, coal, petroleum reside, biomass, and waste feedstocks via syngas. However, such flexibility and diversification is currently not widely available. Therefore, there exists a need to address the issues discussed hereinabove.

SUMMARY OF THE INVENTION

A fuel composition for use in jets, gas turbines, rockets, or diesel engines comprising:

(a) from about 5% to about 99% by weight of the fuel composition of formula (I)

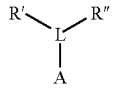

(I)

wherein A is selected from benzene, toluene, xylene, cyclohexane, and mixtures thereof, more preferably A is benzene, toluene, or cyclohexane, most preferably benzene; such that A is non-terminally attached to the L moiety and further such that A is directly connected to the L moiety; R' is selected from hydrogen and $C_1$ to $C_3$ alkyl; R" is selected from hydrogen and $C_1$ to $C_3$ alkyl; wherein both of R' and R" are nonterminally attached to the L moiety; the L moiety is a linear acyclic aliphatic hydrocarbyl such that the sum of carbons in the L moiety, R', and R" is from 5 to 25 carbons;

b) at least about 0.01% of fuel additives; and (c) about 0% to about 90% of conventional jet, gas turbine, rocket or diesel blendstocks, preferably ultra low sulfur refined petroleum blendstocks or Fischer Tropsch blendstocks.

DETAILED DESCRIPTION OF THE INVENTION

Restrictions on gasoline content, such as benzene, shorter chain ($C_5$ to $C_9$) linear, and lightly branched alkanes, have made or will make available components which can be used to alklyate aromatics to make monoaromatics used in jet and diesel fuels. The use of monoaromatics as fuels, specifically alkylbenzenes made from benzene and surplus conventional petroleum components or Fischer-Tropsch derived shorter chain ($C_5$ to $C_{14}$) linear, and lightly branched alkanes, may be beneficial in multiple ways. Use of such benzenes and shorter chain ($C_5$ to $C_{14}$) linear, and lightly branched alkanes would add to the volume of jet fuel, which is an identified need, while removing undesired materials from gasoline for use in motor vehicles. Additionally the fuel of the present invention has multiple desired properties such as higher flash point, lower pour point, high temperature stability, oxidative stability, increased density, better lubricity, reduction in toxicity in its own right, and can deliver benefits in blendstocks. These identified properties provide improved fuels especially for higher performance aircraft featuring conventional jet, ramjet, scramjet, rocket, or pulse detonation engines and the like.

Shorter paraffinic chainlengths from $C_5$ to $C_9$ may be combined with aromatics such as benzene and, optionally, aromatics reduced to cyclohexanes to form a fuel having several desirable attributes for jet, gas turbine, rocket, and diesel fuel. Alkylating benzene with mostly linear olefins and/or olefins from paraffins would be an alternative way of increasing branching of the olefins and/or olefins from paraffins as opposed to hydroisomerization. In other words, the fuel of the present invention presents a viable and cost effective method of increasing branching of low molecular weight Fischer-Tropsch products. The fuel of the present invention may also be derived from non-petroleum feedstocks such as natural gas, coal, tar sands, or oil shale. The diversified production sources listed provide a highly desirable fuel source flexibility.

An identified problem in the jet and diesel fuel area is the ability of a fuel to deliver multiple properties, such as lower pour point, increased lubricity, increased flash point, reduction in toxicity, compatibility in blendstocks with conventional or ultra low sulfur conventional jet, gas turbine, rocket, and/or diesel fuels, among other properties. Additionally, the alkylaromatics may be hydrogenated to alkylcyclohexanes to make fuels capable of providing endothermic cooling in special high performance aircraft engines/airframes of the future.

The fuel of the present invention may also be preferably used as part of a blendstock for use in hydrocarbon fuel-powered equipment, nonlimiting examples such as camp stoves, chainsaw, generators, and the like. Fuels, herein after referred to as "universal battlefield fuel", such as the fuel of the present invention may be used in various hydrocarbon fuel-powered machines. As used herein "hydrocarbon fuel" means gasoline, kerosene, fuel oil, and diesel. Furthermore, higher flash point, increased density, better lubricity of the fuel of the present invention's alkylaromatics or blends of alkylaromatics with conventional fuels such as highly processed jet fuels or Fischer-Tropsch jet fuels may render the fuel of the present invention more suitable for use in military diesel engines as well, thus improving applicability of universal battlefield fuels. These benefits could also be useful in common vehicle and off-road diesel fuels generally when blended with highly processed conventional or Fischer-Tropsch diesel stocks.

The fuel composition comprises from about 5 wt % to about 99 wt % by weight of the fuel composition of an alkylaromatic or alkylcyclohexane of formula (I):

(I)

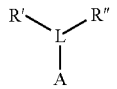

wherein the A moiety is selected from an aromatic moiety, a moiety derived from an aromatic moiety, such as cyclohexane, and mixtures thereof. Preferably, the A moiety is benzene, toluene, xylene, cyclohexane, and mixtures thereof, more preferably the A moiety is benzene, toluene, or cyclohexane, most preferably benzene or cyclohexane. The A moiety, such as benzene may be derived from petroleum or coal, such as coal oil. The A moiety is nonterminally attached to the L moiety. The A moiety is also such that it is directly connected to the L moiety, or in other words, there is no methylene moiety between the A moiety and the L moiety.

R' is selected from hydrogen and $C_1$ to $C_3$ alkyl. Preferably, R' is hydrogen, methyl or ethyl, more preferably, R' is hydrogen or methyl. R' is nonterminally attached to the L moiety. That is, R' does not add to the overall chain length of the L moiety, but rather, is branching from the L moiety.

R" is selected from hydrogen and $C_1$ to $C_3$ alkyl. Preferably, R" is hydrogen, methyl or ethyl, more preferably, R" is hydrogen or methyl. R" is nonterminally attached to the L moiety. That is, R" does not add to the overall chain length of the L moiety, but rather, is branching from the L moiety. The fuel of the present invention is such that R' and R" are selected to achieve a lightly branched alkylaromatic or alkylcyclohexane, further discussed below, having an average of about 1.0 to about 1.5 branches per molecule.

The L moiety is an acyclic aliphatic hydrocarbyl such that L+R'+R" is from 5 to 25 carbon atoms. In a preferred embodiment of the fuel of the present invention the total carbons of L, R', and R" is from 5 to 7. In another preferred embodiment of the fuel of the present invention the total carbons of L, R', and R" is from 8 to 10. In another preferred embodiment of the fuel of the present invention the total carbons of L, R', and R" is from 10 to 14. In another preferred embodiment of the fuel of the present invention the total carbons of L, R', and R" is from 5 to 14. The preferred L moiety is: R'''—C(—)H$(CH_2)_v$C(—)H$(CH_2)_x$C(—)$(CH_2)_y$—$CH_3$, wherein the three C(—) indicate the three carbon atoms where the A moiety, R', and R" may be attached to formula (II) below:

(II)

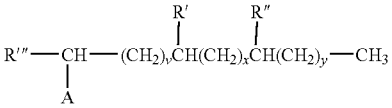

wherein R', R" and the A moiety are hereinbefore defined such that there are no quaternized carbon atoms in the compounds of formula I or formula II.

R''' is selected from $C_1$ to $C_6$ alkyl. Preferably R''' is $C_1$ to $C_3$ alkyl, more preferably R''' is methyl or ethyl. The numbers of the methylene subunits, v, x and y are each independently integers from 0 to 10 provided that the total number of carbons excluding carbons of the A moiety (e.g., in formula (I), the sum of carbons in L, R', and R"; in formula (II), the sum of carbons in R', R", R''', and C(—)H$(CH_2)_v$C(—)H$(CH_2)_x$C(—)$(CH_2)_y$—$CH_3$) is between 5 and 25 carbon atoms. Therefore, not being limited by example, 2-phenylpentane would equate to formula (I) having the L moiety being a acyclic aliphatic hydrocarbyl having 5 carbon atoms, R' and R" being hydrogen, and the A moiety being benzene; or formula (II) having v, x, and y being 0, R' and R" being hydrogen, R''' being a $C_1$ and the A moiety being benzene.

In the fuel of the present invention, the A moiety is preferably attached to the L moiety in the position which is selected from positions alpha- and beta- to either of the two terminal carbon atoms of the L moiety, preferably the A moiety is attached to the L moiety in position alpha- to a terminal carbon atom of the L moiety. The terms alpha- and beta- mean the carbon atoms that are one and two carbon atoms away, respectively, from the terminal carbon atoms. To better explain this, the structure below shows the two possible alpha-positions and the two possible beta-positions in a general linear hydrocarbon.

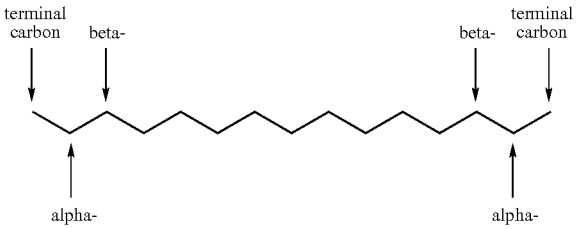

Furthermore, in the first aspect of the invention, the fuel composition may have a molar ratio of nonquaternary to quaternary carbon atoms in the L moiety of formula (I) or the combination of R''' and C(—)H$(CH_2)_v$C(—)H$(CH_2)_x$C(—)$(CH_2)_y$—$CH_3$ moiety of formula (II) of at least about 50:1, and most preferably at least 200:1.

Any of the alkylaromatics, preferably alkylbenzene, may be partially or completely converted to the corresponding alkylcyclohexanes via catalytic hydrogenation, should lower aromaticity or no aromaticity be required of a specific fuel. Such an embodiment is not preferred due to cost consideration for conventional jet, gas turbine, rocket, and/or diesel fuel composition applications. However, conversion to alkylcyclohexanes may be useful in application where extra cost is warranted. Conversion to alkylcyclohexanes may be useful in special aircraft or rocket fuel applications where extra cost is warranted, for example for endothermic cooling properties. The conversion from an alkylaromatic, such as alkylbenzene, to an alkylcyclohexane, may be accomplished by the step of hydrogenating the alkyl aromatic, preferably alkylbenzene, to an alkylcyclohexane.

The fuel of the present invention may deliver one of the properties discussed below; however, it is preferred that the fuel of the present invention delivers multiple benefits.

Fuel Density—The fuel of the present invention has a density of at least about 0.700 g/mL, preferably about 0.700 g/mL to about 0.900 g/mL, more preferably from about 0.750 to about 0.860 g/mL. The fuel density may be measured by ASTM D 1298 (API Gravity) or ASTM D 4052 (Digital Density Meter). Fuel density usually is used to predict energy content of a jet fuel composition. Less dense jet fuels have a higher gravimetric energy content (energy per unit weight of fuel), and more dense jet fuels have a higher volumetric energy content (energy per unit volume of fuel). A more dense fuel with a high volumetric energy content is generally preferred.

Fuel economy of diesel fuel is related to the heating value or energy content of the diesel fuel. Heating value per liter or gallon is directly proportional to density when other fuel properties are unchanged. Relative density (RD), also called specific gravity, or API gravity (ASTM D 287), while more conventional reporting methods for density, can easily be determined by one skilled in the art from the density of the fuel of the present invention.

Cetane index may be measured by ASTM D 976 and ASTM D 4737 (four variable equation). The fuel of the present invention when in the form of a diesel fuel has a cetane index at least about 40, preferably from about 40 to about 70. This can be achieved by blending with a paraffinic/isoparaffinic Fischer-Tropsch or highly hydrogenated conventional petroleum diesel stocks. The cetane index is a calculated quantity that is intended to approximate the cetane number, measured by ASTM D 613.

The aromatic content of the fuel of the present invention may be measured by ASTM D 1319 for jet and diesel fuels. Aromaticity for diesel fuels may be measured by ASTM D 5186. It is preferred that the fuel of the present invention is essentially free of polycyclic, particularly polycyclic aromatic substitutents, including naphthalenes, alkylnaphthalenes, and tetralins, and is essentially free of unreacted (or free) benzene, toluene, and xylene. As used herein "essentially free" refers to having less than 10 ppm present in the fuel composition of the present invention. Without being limited by a theory, it is believed that the removal of sulfur and polycyclics such as naphthalenes from fuels result in fuels having reduced seal swelling abilities. It is believed that the alkylaromatics, preferably alkylbenzenes of the fuel of the present invention provide seal swelling benefits.

Freeze Point—The freeze point of fuels can be over a wide range of temperatures. Wax crystals are the first indications that a fuel is freezing. After wax crystals are formed, the fuel becomes a slush of fuel and crystals, then forming a solid mass. Freeze point, as used herein, refers to the temperature at which the last wax crystal melts, when warming a fuel that has previously been cooled until wax crystals form. Jet fuels generally are discussed in terms of freeze point. The freeze point measurement for jet fuels employs several standard test methods, including ASTM D 2386 (Referee Method), ASTM D 4305 (Filter Flow), ASTM D 5901 (Automated Optical Method), and ASTM D 5972 (Automatic Phase Transition Method). Jet fuels require pumpability to move from the jet fuel tank to the jet engine. The pumpability of the jet fuel should be more than 4° C. below the freeze point of the jet fuel. Diesel fuels are generally discussed in terms of pour point or cloud point. Cloud point is measured by ASTM D 2500 and Pour Point is measured by ASTM D 97. The pour point of the fuel of the present invention is at least about −40° C., preferably from about −40° C. to about −80° C., preferably from about −47° C. to about −80° C. for jet, rocket, or gas turbine engines. The pour point of the fuel of the present invention is at least about −20° C., preferably about −20° C. to about −80° C. for diesel engines. The pour point of the fuel of the present invention makes it highly desirable for low temperature operability due to good low temperature viscosities. Low Temperature Operability may be measured by IP 309 (CFPP) or ASTM D 4539 (FTFT). Without being limited by a theory, it is believed that the low pour point of the fuel of the present invention, despite the molecular weight of the fuel of the present invention, also translates into acceptable flash point, as discussed below.

Flash Point—The fuel of the present invention has a flash point from about 30° C. to about 145° C., preferably from about 60° C. to about 145° C. Flash point for jet fuel may be measured by ASTM D56 (Tag Closed Tester or Referee Method) or ASTM D 3828 (Small Scale Closed Tester). Flash point for diesel fuel may be measured by ASTM D 93 (Pensky-Marten Closed Cup Tester). A raised flash point will be especially useful for hot fueling of fuel tanks. As used herein "hot fuel" means refilling the fuel tank of a machine such as an aircraft or motorized vehicle that is running or still hot from being run. Higher flash points of the fuels of the present invention may also allow for reduction in fueling time critical in military and jumbo civilian aircraft. Another desired result of raising flash points above present specifications is desirable to increase safety, reduce the danger of fuel tank explosions, and increasing chances of surviving crashes or fires when fueling and flying aircraft.

Thermal Stability—the fuel of the present invention may demonstrate improved thermal stability, which is important to jet, gas turbine, rocket, and diesel fuels as fuels are used to cool engines and other parts of the jet engine, gas turbine, rocket engine, and diesel engines. Without stability at higher temperatures, gum and particulate formation increases causing damage to engines. Standardized testing includes Jet Fuel Thermal Oxidation Tester (JFTOT) (ASTM D3241). Diesel fuel thermal stability is measured by Octel/Dupont F21-150° C. Accelerated Fuel Oil stability Test. The fuel of the present inventions should meet or exceed conventional fuel thermal stability standards. Thermal stability may be measured in the presence of oxygen (oxidative stability) or the absence of oxygen.

Lubricity—Lubricity of jet, gas turbine, rocket, and diesel fuel is impacted by the aromatic content as well as the oxygen, nitrogen, and sulfur containing compound content. As governmental regulations seek to decrease the content of aromatics, oxygen, nitrogen, and sulfur containing compounds, lubricity of the fuel is decreased. The fuel of the present invention preferably demonstrates self-lubing properties alone or in a blendstock. Lubricity for jet fuel is measured by ASTM D 5001 (BOCLE Test). ASTM D 975 measures hydrodynamic lubrication in diesel fuels.

Particulate Reduction/Luminosity Reduction—Particulates are formed by incomplete combustion of fuels. These particulates are harmful to the jet and diesel engines mechanically, and can form the smoke emitted from engines. Polycyclics are the major cause of smoke and soot produced by fuels; however, the fuel of the present invention is essentially free of polycyclic aromatics and therefore minimizes the formation of harmful particulates. The fuel of the present invention, when in the form of a jet fuel, has a minimum smoke point of at least about 20 mm. Smoke Point is measured by ASTM D 1322. With jet fuels these particulates can become incandescent under the high temperature and pressure conditions of the combustion section. This too may lead to cracks and premature engine failures Diesel fuels require the ash content to have a maximum of 100 ppm. ASTM D 482 measures ash content in diesel fuels.

Other fuel properties may be required by known fuel specifications that have not been discussed above. Properties such as antistatic, corrosion resistance, anti-growth, oxidative stability, and thermal stability in the absence of oxygen, may also be delivered by the fuel of the present invention. The fuel of the present invention, without being limited by a theory, is believed to have less inherent toxicity compared to conventional fuels and is believed to be aerobically more environmentally friendly than conventional fuels.

The fuel of the present invention may be derived from several different starting materials including olefins, paraffins, and alcohols. The fuel of the present invention utilizes not only linear alkylaromatics and linear alkylcyclohexanes, but also lightly branched alkylaromatics and alkylcyclohexanes.

Linear Alkylaromatics

Linear alkylaromatics, such as alkylbenzene, can be made by the alkylation of an aromatic moiety, preferably benzene, by a Friedel-Crafts reaction, similar to the manufacturing process utilized for detergents, with adjustments for potential inclusion of carbon chain lengths as short as $C_5$. Starting materials of alkylation process include n-paraffins, n-olefins, and mixtures thereof and aromatic materials including benzene, toluene, xylene, and mixtures thereof.

The n-paraffins, n-olefins, and mixtures thereof may undergo steps prior to the alkylation process to produce linear materials suitable for the alkylation step with the aromatic materials. For example, paraffins may be converted into chloroparaffins and alkylated in the presence of aluminum chloride. The chloroparaffins may also be converted to linear olefins and alkylated in the presence of aluminum chloride. Paraffins may also be directly converted to linear olefins via the PACOL® process, by UOP Inc., followed by selective hydrogenation (DEFINE® Process, by UOP Inc.), then used in the alkylation process.

The selected starting materials including n-paraffins, n-olefins, and mixtures thereof, and aromatic starting materials, such as benzene, toluene, xylene, and mixtures thereof are mixed with an alkylation catalyst to form the alkylaromatics via an alkylation step. Aluminum chloride and hydrogen fluoride may be used as alkylation catalysts in the alkylation process. Further discussion of such process may be found in Ullmann's Encyclopedia of Industrial Chemistry, Vol. 35, pages 293-368, entitled "Surfactants". Such procedures are also discussed in Kirk-Othmer Encyclopedia of Chemical Technology, 3rd Edition, Vol. 2, pages 50-70, in the article entitled "Alkylation". See also U.S. Pat. No. 5,344,997, U.S. Pat. No. 5,196,574, U.S. Pat. No. 5,334,793, and U.S. Pat. No. 5,245,094.

Solid-Bed Alkylation for producing linear alkylaromatics, known as the DETAL® process, which was co-developed by UOP Inc. and Petresa Inc., may also be used to produce the linear alkylaromatics, preferably alkylbenzene for the fuel of the present invention. Further discussion of the DETAL® process is found in World Surfactants Congress, 4th, Barcelona, Jun. 3-7, 1996 (1996), pages 117-189 (ISBN 0-85404-751-4). The DETAL® process may further comprise the use of the DEFINE® process, licensed by UOP Inc., for selective hydrogenation converting diolefins to monoolefins, which then may be used in the alkylation proces. The DETAL® process may further comprises the PEP® process, licensed by UOP, for adsorption and fractionation of aromatic compounds undesired in the fuel of the present invention. Uses of such processes are preferred in the fuel of the present invention.

Lightly Branched Alkylaromatics

The fuel of the present invention may also comprise lightly branched alkylaromatics and alkylcyclohexanes. As used herein "lightly branched" refers to the branching on olefins or olefins derived from paraffins utilized as feedstocks for the alkyl moiety of the fuel of the present invention (e.g., formula (I): L, R' and. R"), wherein the olefins or olefins derived from paraffins comprise selected short chain ($C_1$ to $C_4$ alkyl) branches such that about 20 wt % to about 100 wt %, by weight of the alkylaromatic and/or alkylcyclohexane molecules have an average of 1.0 to about 1.5 branches per molecule. As used herein "linear" refers to the alkyl moiety of the fuel of the present invention (e.g., formula (I): L, R' and R") having less than about 5 wt % of one methyl branch per molecule. The fuel of the present invention also includes a mixture of linear and lightly branched alkylaromatics, a mixture of linear and/or lightly branched alkylcyclohexane, and mixtures thereof.

Several processes may be used to make lightly branched alkylaromatics prior to the alkylation process. Linear reduction of olefins and paraffins via skeletal isomerization followed by alkylation is a process discussed in WO 99/05082. Processes utilizing alcohols and alkylation of aromatic moieties are also applicable to the fuel of the present invention.

Lightly Branched Modification via Skeletal Isomerization of Olefin—Preferred starting-material olefins for lightly branched modification of olefins by skeletal isomerization herein are alpha-olefins. Suitable olefins can in general be obtained from any source, including those made from kerosene processed through the PACOL® and OLEX® processes of UOP Inc. or less preferably via the older Shell Inc. (CDC) process; alpha-olefins generated by ethylene polymerization, for example by the Shell, Gulf/Chevron, or Amoco (formerly Ethyl Corp.) processes; alpha olefins derived from cracked wax; alpha-olefins derived from Fischer-Tropsch syntheses, or internal olefins from Shell's SHOP® process.

Skeletal isomerization of olefins utilized herein can, in general, be accomplished in any manner known in the art. Suitable constrained skeletal isomerization catalysts are known for various purposes and include those selected from the group consisting of zeolites and silicoaluminophosphates, including, but not limited to: ALPO-31®, SAPO-11®, SAPO-31® and SAPO-41®; preferably SAPO-11®. See U.S. Pat. No. 5,510,306. The preferred catalysts comprise substantially only zeolites. Further examples are discussed in WO 99/05082.

Skeletal isomerization of linear paraffin—Preferred starting-material paraffins for delinearization of paraffins by skeletal isomerization herein are linear paraffins. Suitable paraffins can more generally be obtained from any source, such as those derived from kerosene treated by UOP's MOLEX® process. In general, any catalyst suitable for alkyl branching, preferably methyl branching, of a linear paraffin is useful in the instant process. Preferred skeletal isomerization catalysts for this step include (i) zeolites having ferrierite isotypic framework structure (more preferably H-ferrierites); (see for example U.S. Pat. No. 5,510,306) and (ii) ALPO-31®, SAPO-11®, SAPO-31® and SAPO-41®. Lightly branched paraffins from Fischer-Tropsch are preferred materials.

Dehydrogenation of skeletally isomerized paraffin—In general, dehydrogenation of the skeletally isomerized paraffin in the instant process can be accomplished using any of the well-known dehydrogenation catalyst systems. Dehydrogenation can be conducted in presence of hydrogen gas and commonly a precious metal catalyst is present though alternatively non-hydrogen, precious-metal free dehydrogenation systems such as a zeolite/air system can be used with no precious metals present. As is well known, dehydrogenation can be complete or partial, more preferably partial. When partial, dehydrogenation step forms a mixture of olefin and unreacted paraffin. Such mixture is a suitable material for the alkylation step of the alkylation process.

Use of Alcohols

Alternatively, a process may provide an alcohol or alcohol mixture having molecular weight of from about 144 to about 242. In general, suitable alcohol can be made by selective hydroformylation of Fischer-Tropsch olefins, or skeletally isomerized linear olefins, by positionally nonselectively hydroformylating linear olefins and by reactions of Grignard reagents or suitable equivalent organometallics such as organolithium reagents, with methyl alkyl ketones. The alcohol may be used in the alkylation step to alkylate the aromatic moiety, in the manner discussed above.

Alcohols via Grignard technique—In the Grignard technique, a mixture of ketones such as 2-hexanone, 2-heptanone, and 2-octanone at a 2:2:1 mole ratio are reacted with an alkyl Grignard reagent such as hexylmagnesium bromide. On workup, a mixture of alcohols, in the case of this specific illustration 5-methyl-5-undecanol, 6-methyl-6-dodecanol and 7-methyl-7-tridecanol, is secured.

Despite the seemingly counterintuitive use of alcohols rather than olefins to make the fuel of the present invention, the process has some unique advantages, for example in that alcohols can be dehydrated, isomerized and alkylated herein in one step through the use of a catalyst such as a zeolite with acidic sites within the catalyst. Moreover, alcohols can be conveniently made and used to conduct tailored batch syntheses of the alkylaromatics for use in the fuel of the present invention at relatively small scales using commercially available alcohols such as natural, Ziegler, or NEODOL® alcohols, even when the corresponding olefins are not readily available in relatively small quantities.

Mixtures of linear alkylaromatics, linear alkylcyclohexane, lightly branched alkylaromatic, lightly branched alkylcyclohexane, and mixtures thereof may comprise the fuel of the present invention. Fischer-Tropsch processes are a preferable source of the mixtures of linear and/or lightly branched alkylaromatics, preferably linear and/opr lightly branched alkylbenzene. These mixtures may be obtained from several points in Fischer Tropsch (F.T.) process. Examples of different points include obtaining the desired materials from straight run F.T. processes, hydroisomerate/hydrocrackates from F.T. middles distillates, hydrocrackates from F.T. lube making, and hydrocrackates from F.T. wax. The hydrocrackates yield paraffins, which require an additional step of deydrogenation to olefins, as defined above in the linear alkylaromatic section. The use of hydrocrakages from F.T. technology is as used in making alkylbenzenes for detergents. Alternatively, cracking could replace hydrocracking in these steps to make olefins directly for use as fuels of the present invention. Steam or nitrogen cracking of waxes is known in alkylbenzene processes and may be utilized in making the fuel of the present invention. F.T. plants will produce adequate amounts of steam and nitrogen to practice the cracking process to produce the fuel of the present invention.

Alkylation

The process for making lightly branched alkylaromatics for use in the fuel of the present invention further includes the step after the modification to form lightly branched olefins and/or paraffins, a monoalkylation step of reacting the lightly branched olefin and/or paraffin with an aromatic moiety selected from benzene, toluene, xylene, and mixtures thereof, preferably benzene.

Alkylation Catalyst

A suitable alkylation catalyst herein may be selected from shape-selective moderately acidic alkylation catalysts, preferably zeolitic. The zeolite in such catalysts for the alkylation step is preferably selected from the group consisting of mordenite, ZSM-4®, ZSM-12®, ZSM-20®, offretite, gmelinite and zeolite beta in at least partially acidic form. Particularly preferred alkylation catalysts herein include the acidic mordenite catalysts ZEOCAT® FM-8/25H available from Zeochem; CBV 90 A®, available from Zeolyst International, and LZM-8® available from UOP Chemical Catalysts. A further discussion of suitable alkylation catalysts is found in WO 99/05082. Further discussions on the process may be found in WO 99/05084 and WO 00/12451.

Fuel Additives

The fuel of the present invention may optionally comprises at least about 0.01 wt %, preferably from about 0.01% to about 5%, preferably from about 0.1% to about 5% by weight of the fuel composition of a fuel additive.

Jet fuel additives such as antioxidants, metal deactivators, electrical conductivity or static dissipaters, corrosion inhibitors, lubricity improvers, fuel system icing inhibitors, biocides, thermal stability additives, soot/particulate reduction agents, and any combination thereof may be added to the fuel of the present invention. A discussion of these additives may be found in Kirk Othmer Encyclopedia of Chemical Technology, Fourth Edition, Volume 3, pages 788-812, entitled "Aviation and Other Gas Turbine Fuels", specifically, page 795, Table 5.

Diesel Fuel Additives may include cetane index improvers such as 2-ethylhexyl nitrate (EHN), injector cleaning additives, lubricity additives (i.e., fatty acids and esters), smoke suppressants (i.e., organometallic compounds), fuel handling additives such as antifoam additives (i.e., organosilicone compounds), de-icing additives (i.e., low molecular eight alcohols or glycols), low temperature operability additives; drag reducing additives (i.e., high molecular weight polymers) antioxidants such as phenylenediamine, stabilizers, metal deactivators (e.g., chelants), dispersants, biocides, demulsifier, corrosion inhibitors, and any combinations thereof may comprise the fuels of the fuel of the present invention. A discussion of diesel fuel additives may be found in Kirk Othmer Encyclopedia of Chemical Technology, Fourth Edition, Volume 12, pages 341-388, entitled "Gasoline and other Motor Fuels", specifically pages 379-81.

Conventional Jet or Diesel Blendstocks

The fuel of the present invention may optionally comprise conventional jet or diesel blendstocks. Preferably, these blendstocks are low sulfur blendstocks or Fischer Tropsch blendstocks. As used herein "conventional" refers to jet or diesel fuels commercially available or known in the art.

The fuel of the present invention comprises no greater than 95 wt %, preferably from about 0 wt % to 90 wt %, preferably from 0 wt % to 80 wt %, preferably from 0 wt % to about 50 wt % by weight of the fuel composition of convention jet or diesel fuels.

Methods of Use

The present invention further comprises a method of powering a diesel engine through the burning of a fuel comprising the steps of compressing air in the diesel engine, injecting the fuel of the present invention, igniting the air and fuel to form a burning mixture.

The present invention further comprises a method of powering a jet or gas turbine engine through the burning of a fuel comprising the steps of drawing air from the front of the jet engine or gas turbine into the jet engine or gas turbine, mixing the air with the fuel of Claim 1, igniting the air and fuel mixture to form a burning mixture, and ejecting the burning mixture out of the back of the jet engine or gas turbine.

The present invention further comprises a method of powering a rocket through the burning of a fuel comprising the steps of mixing the fuel of Claim 1 with an oxidant such as oxygen or nitrous oxide, and mixture thereof, igniting the oxygen, nitrous oxide, and mixtures thereof and fuel to form a burning mixture, and ejecting the burning mixture from the rocket. The present invention further comprises, although not preferred, a method of powering a vehicle having a power system consisting of a at least 70 MPa direct injection diesel engine, preferably of the common rail type, or a hybrid power system comprising the engine and an electric motor comprising a step of combusting the fuel composition of the present invention.

The present invention further relates to a method for powering a ramjet or scramjet. A ramjet has no moving parts and achieves compression of intake air by the forward speed of the air vehicle. Air entering the intake of a supersonic aircraft is slowed by aerodynamic diffusion created by the inlet and diffuser to velocities comparable to those in a turbojet augmentor. The expansion of hot gases after fuel injection and combustion accelerates the exhaust air to a velocity higher than that at the inlet and creates positive push. Scramjet is an acronym for Supersonic Combustion Ramjet. The scramjet differs from the ramjet in that combustion takes place at supersonic air velocities through the engine. Hydrogen is normally the fuel used. Pulse detonation engines are also intended to be included in the method of the present invention. The method of the present invention comprises the steps of decomposing the fuel composition of the present invention, preferably via catalytically dehydrogenating, into hydrocarbon components and hydrogen, and cooling of adjacent engine and airframe parts through endothermic cooling. The hydrocarbon components and hydrogen are then burned. The burning hydrogen is also used to maintain flame under ramjet or scramjet conditions.

EXAMPLE 1

Linear Alkylbenzene Prepared Via Alkylation with Alkyl Chlorides

A homologous mixture of $C_5$-$C_{25}$ linear alkanes is reacted with gaseous chlorine at 100-140° C. in a chlorination tower to a conversion of 30 mol %. Suitable reactor materials are lead, silver, or enamel; iron is not suitable. The hydrogen chloride release in the reaction $RH+Cl_2 \rightarrow RCl+HCl$ escapes from the chlorination tower and is washed in a countercurrent fashion with fresh alkane. The alkyl chlorides and unreacted paraffin are passed to the alkylation stage. The alkylation catalyst, aluminum chloride, is a liquid complex compound in the reaction mixture and containing up to containing up to 35 wt % aluminum chloride. The alkylation is preferentially carried out in glass-lined reaction towers at 80° C. Benzene is added in molar excess and hydrogen chloride is released in stoichiometric amounts according to the equation $RCl+C_6H_6 \rightarrow RC_6H_5+HCl$. The catalyst complex is separated out and unreacted benzene and paraffin preferably are removed.

EXAMPLE 2

Linear Alkylbenzene Prepared Via Alkylation with Olefins

Dehydrogenate $C_5$-$C_{25}$ n-alkanes at ca. 500° C. with a slight hydrogen excess pressure of ca. 300 kPa (3 bar) over a fixed-bed of modified platinum catalyst on aluminum oxide. See U.S. Pat. No. 5,672,797 and U.S. Pat. No. 5,962,760, assigned to UOP Inc., for further discussion regarding suitable catalysts. The alkane conversion is held at 1-15 wt % to minimize further dehydrogenation to diolefins and aromatics. Optionally, hydrogen released from the reaction is recycled to the dehydrogenation reactor or connected to a reactor for the selective hydrogenation of diolefins to monoolefins (DEFINE® process). The dehydrogenation product, containing 10-15 wt % monoolefins is passed to the alkylation reaction. Benzene and hydrofluoric acid are mixed with the dehydrogenation product at <50° C. with intensive cooling. The acid catalyst is removed and the product may be distilled to obtain the desired products for use in the fuel of the present invention.

EXAMPLE 3

Lightly Branched Alkylbenzene Prepared Via Skeletally Isomerized Linear Olefin Step (a): At Least Partially Reducing the Linearity of an Olefin (by Skeletal Isomerization of Olefin Preformed to Chainlengths Suitable for Fuel Compositions)

A mixture of 1-decene, 1-undecene, 1-dodecene and 1-tridecene (for example available from Chevron) at a weight ratio of 1:2:2:1 is passed over a Pt-SAPO catalyst at 220° C. and any suitable LHSV, for example 1.0. The catalyst is prepared in the manner of Example 1 of U.S. Pat. No. 5,082,956. See WO 95/21225, e.g., Example 1 and the specification thereof. The product is a skeletally isomerized lightly branched olefin having a range of chain lengths suitable for making an alkylbenezene fuel composition. More generally the temperature in this step can be from about 200° C. to about 400° C., preferably from about 230° C. to about 320° C. The pressure is typically from about 0.205 MPa (15 psig) to about 13.9 MPa (2000 psig), preferably from about 0.205 MPa (15 psig) to about 7.0 MPa (1000 psig), more preferably from about 0.205 MPa (15 psig) to about 4.24 MPa (600 psig). Hydrogen is a useful pressurizing gas for the present example. The space velocity (LHSV or WHSV) is suitably from about 0.05 to about 20. Low pressure and low hourly space velocity provide improved selectivity, more isomerization and less cracking. Distill to remove any volatiles boiling at up to 40° C./1.33 kPa (10 mmHg).

Step (b): Using the Product of Step (a) for Alkylating an Aromatic Moiety

To a glass autoclave liner is added 1 mole equivalent of the lightly branched olefin mixture produced in step (a), 20 mole equivalents of benzene and 20 wt % based on the olefin mixture of a shape selective zeolite catalyst (acidic mordenite catalyst ZEOCA® FM-8/25H). The glass liner is sealed inside a stainless steel rocking autoclave. The autoclave is purged twice with 1.83 MPa (250 psig) $N_2$, and then charged to 7.0 MPa (1000 psig) $N_2$. With mixing, the mixture is heated to 170-190° C. for 14-15 hours at which time it is then cooled and removed from the autoclave. The reaction mixture is filtered to remove catalyst and is concentrated by distilling off unreacted starting-materials and/or impurities (e.g., benzene, olefin, paraffin, trace materials, with useful materials being recycled if desired) to obtain a clear near-colorless liquid product.

EXAMPLE 4

Lightly Branched Alkylbenzene Prepared Via Skeletal Isomerization of Paraffin

Step (a i)

A mixture of n-undecane, n-dodecane, n-tridecane, 1:3:1 wt., is isomerized over Pt-SAPO-11 for a conversion better than 90 wt % at a temperature of about 300-340° C., at about 7.0 MPa (1000 psig) under hydrogen gas, with a weight hourly space velocity in the range 2-3 and 30 moles $H_2$/mole hydrocarbon. More detail of such an isomerization is given by S. J. Miller in Microporous Materials, Vol. 2., (1994), 439-449. In further examples, the linear starting paraffin mixture can be the same as used in conventional linear alkyl benzene manufacture. Distill to remove any volatiles boiling at up to 40° C./1.33 kPa (10 mmHg).

Step (a ii)

The paraffin of step (a i) can be dehydrogenated using conventional methods. See, for example, U.S. Pat. No. 5,012,021, Apr. 30, 1991 or U.S. Pat. No. 3,562,797, Feb. 9, 1971. A suitable dehydrogenation catalyst is any of the catalysts disclosed in U.S. Pat. Nos. 3,274,287; 3,315,007; 3,315,008; 3,745,112; 4,430,517; and 3,562,797. For purposes of the present example, dehydrogenation is in accordance with U.S. Pat. No. 3,562,797. The catalyst is zeolite A. The dehydrogenation is conducted in the vapor phase in presence of oxygen (paraffin:dioxygen 1:1 molar). The temperature is in range 450° C.-550° C. Ratio of grams of catalyst to moles of total feed per hour is 3.9:1.

Step (b): Alkylating the Product of Step (a) Using an Aromatic Hydrocarbon

To a glass autoclave liner is added 1 mole equivalent of the mixture of step (a), 5 mole equivalents of benzene and 20 wt %, based on the olefin mixture, of a shape selective zeolite catalyst (acidic mordenite catalyst ZEOCAT® FM-8/25H). The glass liner is sealed inside a stainless steel, rocking autoclave. The autoclave is purged twice with 1.83 MPa (250 psig) $N_2$, and then charged to 7.0 MPa (1000 psig) $N_2$. With mixing, the mixture is heated to 170-190° C. overnight for 14-15 hours, at which time it is then cooled and removed from the autoclave. The reaction mixture is filtered to remove catalyst. Benzene and any unreacted paraffins are distilled and recycled. A clear colorless or nearly colorless liquid product is obtained.

EXAMPLE 5

Lightly Branched Alkylbenzene Prepared Via Specific Tertiary Alcohol Mixture from a Grignard Reaction A mixture of 5-methyl-5-undecanol, 6-methyl-6-dodecanol and 7-methyl-7-tridecanol is prepared via the following Grignard reaction. A mixture of 28 g of 2-hexanone, 28 g of 2-heptanone, 14 g of 2-octanone and 100 g of diethyl ether are added to an addition funnel. The ketone mixture is then added dropwise over a period of 1.75 hours to a nitrogen blanketed stirred three neck round bottom flask, fitted with a reflux condenser and containing 350 mL of 2.0 M hexylmagnesium bromide in diethyl ether and an additional 100 mL of diethyl ether. After the addition is complete, the reaction mixture is stirred an additional 1 hour at 20° C. The reaction mixture is then added to 600 g of a mixture of ice and water with stirring. To this mixture is added 228.6 g of 30% sulfuric acid solution. The resulting two liquid phases are added to a separatory funnel. The aqueous layer is drained and the remaining ether layer is washed twice with 600 mL of water. The ether layer is then evaporated under vacuum to yield 115.45 g of the desired alcohol mixture. A 100 g sample of the light yellow alcohol mixture is added to a glass autoclave liner along with 300 mL of benzene and 20 g of a shape selective zeolite catalyst (acidic mordenite catalyst ZEOCAT® FM-8/25H). The glass liner is sealed inside a stainless steel, rocking autoclave. The autoclave is purged twice with 1.83 MPa (250 psig) $N_2$, and then charged to 7.0 MPa (1000 psig) $N_2$. With mixing, the mixture is heated to 170° C. overnight for 14-15 hours at which time it is then cooled and removed from the autoclave. The reaction mixture is filtered to remove catalyst and concentrated by distilling off the benzene, which is dried and recycled. A clear colorless or nearly colorless lightly branched olefin mixture is obtained.

50 g of the lightly branched olefin mixture provided by dehydrating the Grignard alcohol mixture as above is added to a glass autoclave liner along with 150 mL of benzene and 10 g of a shape selective zeolite catalyst (acidic mordenite catalyst ZEOCAT® FM-8/25H). The glass liner is sealed inside a stainless steel, rocking autoclave. The autoclave is purged twice with 1.83 MPa (250 psig) $N_2$, and then charged to 7.0 MPa (1000 psig) $N_2$. With mixing, the mixture is heated to 195° C. overnight for 14-15 hours at which time it is then cooled and removed from the autoclave. The reaction mixture is filtered to remove catalyst and concentrated by distilling off the benzene which is dried and recycled. A clear colorless or nearly colorless liquid product is obtained. The product is distilled under vacuum (133 Pa-667 Pa or 1-5 mm of Hg) and the fraction from 95° C.-135° C. is retained.

While particular embodiments of the fuel of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention. All documents cited are, in relevant part, incorporated herein by reference; the citation of any document is not to be construed as an admission that it is prior art with respect to the fuel of the present invention.

What is claimed is:

1. A fuel composition for use in jets, gas turbines, rockets, or diesel engines comprising:

(a) from about 5% to about 99% by weight of the fuel composition of formula

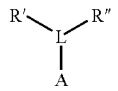

(I)

wherein the A moiety is selected from benzene, cyclohexane, and mixtures thereof, such that the A moiety is non-terminally attached to the L moiety and further such that the A moiety is directly connected to the L moiety; R' is selected from hydrogen and $C_1$ to $C_3$ alkyl; R" is selected from hydrogen and $C_1$ to $C_3$ alkyl; wherein both of R' and R" are nonterminally attached to the L moiety; the L moiety is a linear acyclic aliphatic hydrocarbyl such that the sum of carbons in the L moiety, R', and R" is from 5 to 25 carbons;

(b) at least about 0.01% of fuel additives; and (c) from 0% to about 90% of conventional jet, gas turbine, rocket or diesel blendstocks.

2. The fuel composition according to claim 1 wherein the pour point of the fuel is about −40° C. to about −80° C., for use in a jet, rocket, or gas turbines.

3. The fuel composition according to claim 1 wherein the flash point of the fuel is about 38° C. to about 145° C.

4. The fuel composition according to claim 1 wherein the density is about 0.700 g/ML to about 0.900 g/mL.

5. The fuel composition according to claim 1 wherein the sum of carbons in the combined L moiety, R', and R" is from $C_{5-14}$.

6. The fuel composition according to claim 1 wherein the A moiety is located on the alpha- or beta-carbon to the terminal carbon of the L moiety.

7. The fuel composition according to claim 1 which is essentially free of polycyclic aromatic substitutents and essentially free of unreacted benzene.

8. The fuel composition according to claim 1 wherein the fuel composition is a jet fuel having a minimum smoke point of at least 20 mm.

9. The fuel composition according to claim 1 wherein the fuel composition is a diesel fuel having a cetane index of at least 40.

10. The fuel composition according to claim 5 wherein R' and R" are hydrogen and the A moiety is benzene.

11. The fuel composition according to claim 5 wherein R' is methyl and R" is hydrogen or methyl, and the A moiety is benzene.

12. The fuel composition according to claim 1 wherein the pour point of the fuel is about −20° C. to about −80° C., for use in diesel engines.

* * * * *